United States Patent [19]

Araki

[11] 4,262,592

[45] Apr. 21, 1981

[54] HAMMER DRIVE APPARATUS FOR IMPACT PRINTER

[75] Inventor: Shigeyuki Araki, Tokyo, Japan

[73] Assignee: Ricoh Company, Ltd., Tokyo, Japan

[21] Appl. No.: 26,240

[22] Filed: Apr. 2, 1979

[30] Foreign Application Priority Data

Apr. 6, 1978 [JP] Japan ..... 53-40616

[51] Int. Cl.[3] ..... B41J 7/92

[52] U.S. Cl. ..... 101/93.03; 400/157.3; 400/166

[58] Field of Search .... 101/93.03, 93.48, 93.29–93.34; 400/144.2, 157.3, 166; 318/126; 361/152–154

[56] References Cited

U.S. PATENT DOCUMENTS

| | | | |
|---|---|---|---|
| 3,712,212 | 1/1973 | Beery | 101/93.03 X |
| 3,858,509 | 1/1975 | Grundherr | 101/93.03 X |
| 3,909,681 | 9/1975 | Campari et al. | 101/93.03 X |
| 4,027,761 | 6/1977 | Quaif | 101/93.03 X |
| 4,083,299 | 4/1978 | Norton | 101/93.03 |
| 4,118,129 | 10/1978 | Grundherr | 400/157.3 X |
| 4,162,131 | 7/1979 | Carson et al. | 101/93.03 X |

FOREIGN PATENT DOCUMENTS

| | | | |
|---|---|---|---|
| 1436992 | 5/1976 | United Kingdom | 101/93.03 |

*Primary Examiner*—Edward M. Coven
*Attorney, Agent, or Firm*—David G. Alexander

[57] ABSTRACT

A coil (12), when electrically energized, magnetically drives a printing hammer to impact a type element against paper for printing a character. The coil (12) is connected to a power source (+V) for a predetermined time (T1) during which the hammer moves toward the paper and the current (I) through the coil (12) increases exponentially. Then, the coil (12) is energized for another predetermined time (T2) in response to logically high portions of a train of high frequency drive pulses (B). A diode (23) connected in parallel with the coil (12) maintains current flow through the coil (12) due to counter electromotive force during the logically low portions of the drive pulses (B) by providing a low resistance path across the coil (12).

The average value of current through the coil (12) decreases exponentially during the time the drive pulses (B) are applied. The duty cycle of the drive pulses (B) is varied in accordance with the printing area of the character so that the rate at which the current (I) through the coil (12) decreases and thereby the force of impact of the type element against the paper vary accordingly. This enables all characters to printed with the same density regardless of the printing area thereof.

11 Claims, 2 Drawing Figures

HAMMER DRIVE APPARATUS FOR IMPACT PRINTER

BACKGROUND OF THE INVENTION

The present invention relates to a hammer drive apparatus for an impact printer comprising means for ensuring that all characters will be printed with equal density.

In a typical apparatus of the present type, a hammer is driven by an electromagnet to impact a type element against paper through a ribbon for printing.

A number of type elements for various characters are carried on the spokes of a daisy wheel or similar type element carrier which is rotated to a position for printing the selected character. The various characters have different printing areas. For example, the character "W" has a large printing area whereas the character "i" has a small printing area. If the printing hammer is driven with the same force for printing all characters, the density of the printed character "W" will be lower than the density of the printed character "i". The reason for this is that the impact force is distributed over a larger printing for characters such as "W" than for characters such as "i".

Various expedients have been proposed in the prior art in an attempt to print all characters with equal density. Japanese patent application disclosure No. 52-48926 teaches the construction of an example of the prior art. In this system, a high current is caused to flow through an electromagnetic coil which, when energized, generates an electromagnetic force which drives the hammer to impact the type element and paper. The initial high current causes the hammer to move quickly against static friction and inertia forces. Then, the current is attenuated over a predetermined period of time in accordance with a time constant corresponding to the printing area of the character. The attenuation rate is greater for characters of small printing area than for characters with large printing area so that the impact force is decreased for characters of small printing area and vice-versa.

Although this system is theoretically desirable, it is difficult and expensive to embody in actual practice. This is because accurate analog control of the attenuation of the hammer drive current requires an anlog switch, an operational amplifier, a variable current source and other components which must be constructed and adjusted to operate with a small rate of error. Such an analog control system is expensive and generally low in reliability.

Other known references in the art include Japanese utility model publication No. 52-22179 and Japanese patent application disclosure No. 49-123232. The former reference generally teaches how to drive a coil for a printing hammer in response to a high frequency pulse train. The coil is connected to a power source only when the drive pulses are logically high.

The latter reference discloses means for switching a hammer drive coil into connection with a power source and means for providing a low resistance path across the coil when the coil is disconnected from the power source so that current flow continues for a period of time due to counter electromotice force.

Although these references are relevant to the general field of art, they do not disclose the novel and advantageous combination of the present invention.

SUMMARY OF THE INVENTION

A print hammer drive apparatus embodying the present invention includes a print hammer drive coil. Print gate pulse generator means generate a print gate pulse. Print start pulse generator means generate a print start pulse in response to a leading edge of the print gate pulse, the print start pulse having a shorter duration than the print gate pulse. Print drive pulse generator means generate a train of high frequency print drive pulses having a duty cycle corresponding to a character to be printed. First gate means gate the drive pulses therethrough during a duration of the print gate pulse. Second gate means produce a logical sum of the print start pulse and an output of the first gate means. First switch means connect the drive coil to a power source in response to a high output of the second gate means, and second switch means provide a low resistance path across the drive coil in response to a low output of the second gate means.

In accordance with the present invention, a coil, when electrically energized, magnetically drives a printing hammer to impact a type element against paper for printing a character. The coil is connected to a power source for a predetermined time during which the hammer moves toward the paper and the current through the coil increases exponentially. Then, the coil is energized for another predetermined length of time in response to logically high portions of a train of high frequency drive pulses. A diode connected in parallel with the coil maintains current flow through the coil due to counter electromotive force during the logically low portions of the drive pulses by providing a low resistance path across the coil.

The average value of current through the coil decreases exponentially during the time the drive pulses are applied. The duty cycle of the drive pulses is varied in accordance with the printing area of the character so that the rate at which the current through the coil decreases and thereby the force of impact of the type element against the paper vary accordingly. This enables all characters to be printed with the same density regardless of the printing area thereof.

It is an object of the present invention to provide a hammer drive apparatus for an impact printer which ensures that all characters will be printed with the same density regardless of the printing area of the characters.

It is another object of the present invention to provide a hammer drive apparatus for an impact printer which comprises an improved digital circuit means for varying a printing impact force as a function of a printing area of a character to be printed.

It is another object of the present invention to provide a variable impact force hammer drive apparatus for an impact printer which may be manufactured a low cost on a commercial production basis but operates in an accurate and reliable manner.

It is another object of the present invention to provide a generally improved hammer drive apparatus for an impact printer.

Other objects, together with the foregoing, are attained in the embodiment described in the following description and illustrated in the accompanying drawing.

DESCRIPTION OF THE PREFERRED EMBODIMENT

While the hammer drive apparatus for an impact printer of the present invention is susceptible of numerous physical embodiments, depending upon the environment and requirements of use, substantial numbers of the herein shown and described embodiment have been made, tested and used, and all have performed in an eminently satisfactory manner.

Figure 1:
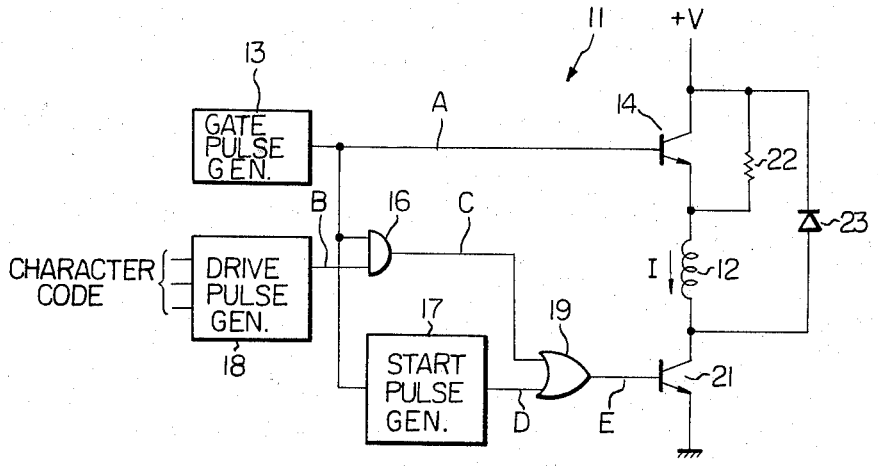
FIG. 1 is an electrical schematic diagram of a hammer drive apparatus for an impact printer embodying the present invention.

Referring now to FIG. 1 of the drawing, a print hammer drive apparatus embodying the present invention in generally designated by the reference numeral 11 and comprises an electromagnetic coil 12. Although not illustrated, the coil 12, in combination with a core, constitutes an electromagnet. When the coil 12 is electrically energized, it produces an electromagnetic field which attracts a print hammer and causes the hammer to impact a type element against a paper through a ribbon to print a character (not shown). The coil 12 is thereby a drive coil for the hammer and causes the hammer to print a character when the coil 12 is energized.

The apparatus 11 further comprises a gate pulse generator 13 which generates a gate pulse A having a time period or duration of T1+T2. Although various logical conventions may be utilized in an electrical apparatus, it will be assumed that all pulses in the apparatus 11 have a logically low value of zero volts and a logically high value which is a suitable positive voltage. Thus, the term "logically high" indicates an active status of the particular pulse and is not intended to have the narrow meaning of a particular signal level, since it is possible to define a negative logic system in which the logically high or active status of a pulse occurs when the actual signal level is more negative than for the logically low or passive status.

The output of the gate pulse generator 13 is connected to the base of an NPN transistor 14 and also to inputs of an AND gate 16 and a start pulse generator 17. The start pulse generator 17 comprises a monostable multivibrator and is constructed to generate a start pulse D in response to the leading edge of the gate pulse A. The start pulse D has a time duration or period equal to T1.

A character code corresponding to the character to be printed is applied to a drive pulse generator 18 which produces a high frequency drive pulse train B. The duty cycle, herein assumed to be equal to the ratio of the period of the logically high portion of each pulse B to the pulse repetition period, is varied as a function of the printing area of character. The generator 18 typically comprises, although not shown in detail, a decoder for decoding the character code, a digital to analog converter for producing a control voltage corresponding to the printing area of the character, a variable duty cycle oscillator and means for pulse width modulating the output of the oscillator in correspondence with the control signal. The particular circuitry of the drive pulse generator 18 may be fabricated using commercially available components and technology and does not constitute a novel feature of the present invention. The output of the drive pulse generator 18 is connected to another input of the AND gate 16. Prior art examples of comparable decoder and control arrangements are found in U.S. Pat. Nos. 4,118,129 and 3,858,509.

Outputs of the AND gate 16 and the start pulse generator 17 are connected to inputs of an OR gate 19 which produces the logical sum of the inputs. The output of the AND gate 16 is designated as C. The output of the OR gate 19 is designated as E and is connected to the base of an NPN transistor 21.

The collector of the transistor 14 is connected to a positive D.C. source +V. The emitter of the transistor 21 is grounded. The coil 12 is connected between the emitter of the transistor 14 and the collector of the transistor 21. A resistor 22 is connected between the emitter and collector of the transistor 14. The anode of a diode 23 is connected to the collector of the transistor 21. The cathode of the diode 23 is connected to the collector of the transistor 14. The conventional current through the coil 12 is designated as I and is positive when flowing downwardly through the coil 12 as indicated by an arrow.

In operation, the gate pulse generator 13 generates the gate pulse A which turns on the transistor 14 and enables the AND gate 16. This enables the pulse width modulated drive pulses B to be gated through the AND gate 16 to constitute the pulses C.

Figure 2:
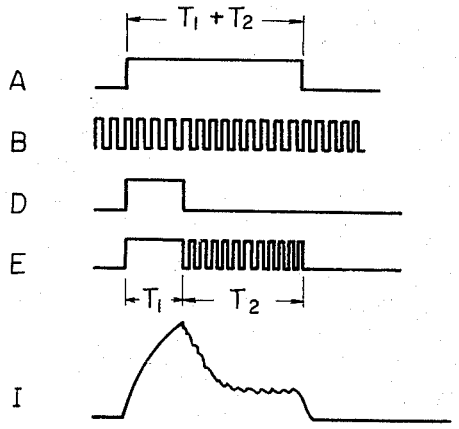
FIG. 2 is a timing diagram illustrating the operation of the present apparatus.

The start pulse generator 17 is triggered by the leading edge of the gate pulse A and produces the start pulse D. Both pulses C and D are applied to the OR gate 19, which produces a high output for the time T1 since the start pulse D is high. The high output of the OR gate 19 turns on the transistor 21. This action establishes connection of the coil 12 to the power source +V since both transistors 14 and 21 are turned on. At this time the diode 23 is reverse biased since the voltage at the collector of the transistor 14 is higher than the voltage at the collector of the transistor 21. The various signals are illustrated in FIG. 2.

Connection of the coil 12 to the power source +V causes current I to flow through the coil 12 and thereby causes the hammer to be rapidly accelerated toward the type element and paper for impact printing. The current I rises exponentially as illustrated in FIG. 2 at a time constant which depends on the inductive reactance of the coil 12 and the internal resistances of the coil 12, transistor 14 and transistor 21.

The start pulse generator 17 times out after the time period T1 has elapsed although the output A of the gate pulse generator 13 will be high for an additional time period T2. Although the start pulse D goes low, the drive pulses B are gated through the OR gate 19 to the transistor 21. During the logically high portion of each drive pulse B, the transistor 21 will be turned on and connect the coil 12 to the power source +V in the manner described above. However, during the logically low portion of each drive pulse B, the transistor 21 will be turned off and will disconnect the coil 12 from ground and thereby from the negative end of the source +V.

At the instant the voltage supply to the coil 12 is interrupted, the counter electromotive force generated by current flow through the coil 12 causes the diode 23 to be forward biased. It will be understood that the counter electromotive force in the coil 12 is equal and opposite to the applied voltage. Thus, when the applied voltage is removed, the lower end of the coil 12 will be positive relative to the upper end thereof, and forward bias the diode 23. Under these conditions the diode 23 provides a low resistance path across the coil 12 through which current I is caused to flow by the counter electromotive force in the direction of the arrow. This is the same direction in which current is caused to flow through the coil 12 by the applied voltage from the source +V.

In this manner, the current flow through the coil 12 is maintained by the diode 23 which functions as a switch. The current flow through the diode 23 fills in the gaps between current flow caused by application of the voltage of the source +V.

Since the current supply to the coil 12 is being switched on and off in response to the drive pulses B rather than being applied continuously, the current I through the coil 12 will decrease exponentially during the time period T2. The time constant or rate of decrease depends on the duty cycle of the drive pulses. The greater the duty cycle (the longer the logically high or active portions of the drive pulses), the smaller the rate at which the current I will decrease. The smaller rate of current decrease means that the value of the current I will be higher and that the hammer will impact the type element and paper with higher force. Thus, the duty cycle of the drive pulses is made greater for characters having larger printing area. The purpose of energizing the coil 12 continuously during the time period T1 is to initially accelerate the hammer at a maximum rate to quickly overcome static friction and inertia. The printing impact force is varied during the time period T2 by varying the rate of decrease of current I through the coil 12 in accordance with the duty cycle of the drive pulses B.

The output A of the gate signal generator 13 goes low at the end of the time period T2 turning off the transistor 14 and inhibiting the AND gate 16. This causes both transistors 14 and 21 to be turned off and terminate the voltage supply to the coil 12. Under these conditions, the diode 23 is forward biased and allows current to flow therethrough due to the counter electromotive force in the coil 12. Current flows through the coil 12, diode 23 and resistor 22 until the counter electromotive force in the coil 12 is reduced to zero.

The value of the resistor 22 is selected to provide a suitable time constant for the discharge of the coil 12. A balance is made between the discharge rate of the coil 12, the current I and the counter electromotive force in accordance with practical circuit considerations through optimal selection of the value of the resistor 22.

It is possible to eliminate the resistor 22 if the breakdown voltage of the transistor 14 is high enough. It is also possible to eliminate the transistor 14 and the resistor 22 and connect the diode 23 directly across the coil 12.

The resistance of the resistor 22 is selected to be high so as to cause the current flow through the coil 12 to be attenuated quickly after the transistor 14 is turned off. Although the apparatus 11 is operative with the transistor 14 and resistor 22 omitted, these components are preferably provided since they enable a low resistance path across the coil 12 during the logically low portions of the drive pulses B to smooth the current I and a high resistance path across the coil 12 when the transistor 14 is turned off to quickly attenuate the current I and allow the hammer to return to its rest position quickly.

The frequency of the drive pulses B is made high enouth so that the current flow through the coil 12 will never drop to zero during the time period T2. The particular frequency selected depends on practical design considerations.

In summary, it will be seen that the present invention provides a hammer drive apparatus for an impact printer which ensures that all characters will be printed with equal density regardless of the printing area of the characters. Various modifications will become possible for those skilled in the art after receiving the teachings of the present disclosure without departing from the scope thereof. For example, under certain practical conditions of current attenuation rate and drive pulse frequency the resistor 22 may be replaced by a zener diode. It will further be understood that the transistors 14 and 21 constitute switches which may be replaced by any electrically equivalent switch means. The diode 23 also constitutes a switch means which may be replaced by any means which provides a low resistance path across the coil 12 when the output E of the OR gate 19 is low and the transistor 21 is turned off. Although not illustrated, a typical replacement for the diode 23 may comprise a transistor which is turned on when the output of the OR gate 19 is low and vice-versa.

What is claimed is:

1. A print hammer drive apparatus including a print hammer drive coil, characterized by comprising:

print gate pulse generator means for generating a print gate pulse;

print start pulse generator means for generating a print start pulse in response to a leading edge of the print gate pulse, the print start pulse having a shorter duration than the print gate pulse;

print drive pulse generator means for generating a train of high frequency drive pulses having a duty cycle which increases as a printing area of a character to be printed increases;

first gate means for gating the drive pulses therethrough during a duration of the print gate pulse;

second gate means for producing a logical sum of the print start pulse and an output of the first gate means;

first switch means for connecting the drive coil to a power source in response to a high output of the second gate means; and second switch means for providing a low resistance path across the drive coil in response to a low output of the second gate means.

2. An apparatus as in claim 1, in which the second switch means comprises a diode connected in parallel with the drive coil in such a manner as to be reverse biased when the first switch means connects the drive coil to the power source.

3. An apparatus as in claim 1, further comprising third switch means connected in series with the first switch means for connecting the drive coil to the power source for the duration of the print gate pulse.

4. An apparatus as in claim 3, in which the second switch means comprises a diode connected in parallel with the series combination of the drive coil and third switch means in such a manner as to be reverse biased when the first switch means connects the drive coil to the power source.

5. An apparatus as in claim 4, further comprising resistance means connected in parallel with the third switch means.

6. An apparatus as in claim 5, in which the resistance means comprises a resistor.

7. An apparatus as in claim 6, in which the first and third switch means comprise transistors respectively.

8. A print hammer drive apparatus including a print hammer drive coil, characterized by comprising:

first means for connecting the drive coil to a power source for a first predetermined period of time;

second means for generating a train of high frequency pulses having a duty cycle which increases as a printing area of a character to be printed increases; and third means responsive to the drive pulses for switchingly connecting the drive coil to the power source when the drive pulses are logically high for a second predetermined period of time following the first predetermined period of time.

9. An apparatus as in claim 8, further comprising fourth means for providing a low resistance path across the drive coil during the second predetermined period of time when the drive pulses are logically low.

10. An apparatus as in claim 9, in which the fourth means comprises a diode connected across the drive coil in such a manner as to be reverse biased when the third means connects the drive coil to the power source.

11. A print hammer drive apparatus including a print hammer drive coil and a power source, characterized by comprising:

means for generating a drive signal;

means for generating a print gate pulse;

first switch means for connecting the drive coil to the power source when the drive signal is high;

second switch means for providing a low resistance path across the drive coil when the drive signal is low;

third switch means connected in series with the first switch means for connecting the drive coil to the power source for the duration of the print gate pulse; and counter electromotive force control means for providing a high resistance path in parallel with the third switch means, the second switch means being connected across a series combination of the third switch means and the drive coil.

* * * * *